US010800582B2

(12) United States Patent
Lamberto

(10) Patent No.: US 10,800,582 B2
(45) Date of Patent: Oct. 13, 2020

(54) BEVERAGE CAN LID

(71) Applicant: Michael M. Lamberto, Grenville, SD (US)

(72) Inventor: Michael M. Lamberto, Grenville, SD (US)

(73) Assignee: Michael M. Lamberto, Grenville, SD (US)

( * ) Notice: Subject to any disclaimer, the term of this patent is extended or adjusted under 35 U.S.C. 154(b) by 25 days.

(21) Appl. No.: 16/046,522

(22) Filed: Jul. 26, 2018

(65) Prior Publication Data

US 2019/0084732 A1 Mar. 21, 2019

Related U.S. Application Data

(60) Provisional application No. 62/560,928, filed on Sep. 20, 2017.

(51) Int. Cl.

| | |
|---|---|
| ***B65D 51/20*** | (2006.01) |
| ***B65D 43/02*** | (2006.01) |
| ***B65D 51/24*** | (2006.01) |
| ***B65D 1/16*** | (2006.01) |
| ***B65D 51/00*** | (2006.01) |
| *B65D 43/06* | (2006.01) |

(52) U.S. Cl.

CPC ..... *B65D 43/0218* (2013.01); *B65D 1/165* (2013.01); *B65D 51/007* (2013.01); *B65D 51/245* (2013.01)

(58) Field of Classification Search

CPC .. B65D 43/0218; B65D 1/165; B65D 51/007; B65D 51/245

USPC ..... 220/797, 258.2, 258.3, 799, 258.5

See application file for complete search history.

(56) References Cited

U.S. PATENT DOCUMENTS

| | | | | | |
|---|---|---|---|---|---|
| 1,884,691 | A * | 10/1932 | Holloway | B65D 43/0212 | 220/258.3 |
| 4,749,100 | A * | 6/1988 | Eberhart | B65D 43/0212 | 220/258.2 |
| 5,273,176 | A * | 12/1993 | Diaz | B65D 43/169 | 220/258.2 |
| 5,996,832 | A * | 12/1999 | Nieuwoudt | B65D 51/20 | 220/257.2 |
| 6,207,100 | B1 * | 3/2001 | Weiss | B29C 51/32 | 220/366.1 |
| 6,230,924 | B1 * | 5/2001 | Weiss | B29C 51/32 | 220/366.1 |
| 6,450,358 | B1 * | 9/2002 | Berro | B65D 25/48 | 220/254.7 |
| 7,475,787 | B2 * | 1/2009 | Gruver | B65D 17/165 | 220/258.2 |
| 7,914,640 | B2 * | 3/2011 | Ronnberg | B65D 17/4012 | 156/256 |
| 2002/0008109 | A1 * | 1/2002 | Hirota | B65D 51/20 | 220/258.2 |

(Continued)

*Primary Examiner* — J. Gregory Pickett
*Assistant Examiner* — Niki M Eloshway

(57) ABSTRACT

A sealing lid. The sealing lid includes a lid top portion having an upper surface and a lower surface. An outer concentric ring protrudes from the lower surface of the lid top portion. An inner concentric ring protrudes from the lower surface of the lid top portion. A channel is defined between the outer concentric ring and the inner concentric ring. The sealing lid is configured to releasably secure to a top rim of a beverage can by the top rim friction fitting within the channel.

9 Claims, 3 Drawing Sheets

(56) References Cited

U.S. PATENT DOCUMENTS

| | | | | |
|---|---|---|---|---|
| 2003/0168457 | A1* | 9/2003 | Wang | B65D 51/007<br>220/258.2 |
| 2003/0222083 | A1* | 12/2003 | Pladsbjerg | B65D 17/4012<br>220/254.3 |
| 2008/0230544 | A1* | 9/2008 | Kim | B65D 51/20<br>220/254.7 |
| 2010/0294770 | A1* | 11/2010 | Wing | A47G 19/2205<br>220/270 |
| 2010/0332420 | A1* | 12/2010 | Groening | B65D 51/245<br>705/500 |
| 2015/0163774 | A1* | 6/2015 | Chen | H04W 72/042<br>370/315 |

* cited by examiner

BEVERAGE CAN LID

CROSS-REFERENCE TO RELATED APPLICATION

This application claims the benefit of priority of U.S. provisional application No. 62/560,928, filed Sep. 20, 2017, the contents of which are herein incorporated by reference.

BACKGROUND OF THE INVENTION

The present invention relates to a lid and, more particularly, to a lid used to seal cans of partially consumed beverages.

Currently, when a can of soda, water, juice, etc. is opened, you cannot close or re-seal the can. Therefore, the beverage inside the can is constantly open to debris, bugs etc. until the beverage is finished. Further, the longer a can of soda is open, the more carbonation escapes from the drink, making the soda flat.

As can be seen, there is a need for a device that re-seals a canned beverage.

SUMMARY OF THE INVENTION

In one aspect of the present invention, a sealing lid comprises: a lid top portion comprising an upper surface and a lower surface; an outer concentric ring protruding from the lower surface of the lid top portion; and an inner concentric ring protruding from the lower surface of the lid top portion, wherein a channel is defined between the outer concentric ring and the inner concentric ring, and the sealing lid is configured to releasably secure to a top rim of a beverage can by the top rim friction fitting within the channel.

In another aspect of the present invention, a sealing lid comprises: a lid top portion comprising an upper surface and a lower surface; an outer concentric ring protruding from the lower surface of the lid top portion; and an inner concentric ring protruding from the lower surface of the lid top portion, wherein a channel is defined between the outer concentric ring and the inner concentric ring, and the sealing lid is configured to releasably secure to a top rim of a beverage can by the top rim friction fitting within the channel.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a lid that fits over a top of an opened beverage can and seals it. Once the lid is snapped onto the top of the can, the lid keeps the beverage sealed, fresh and sanitary, preventing debris and bugs from entering.

Figure 1:
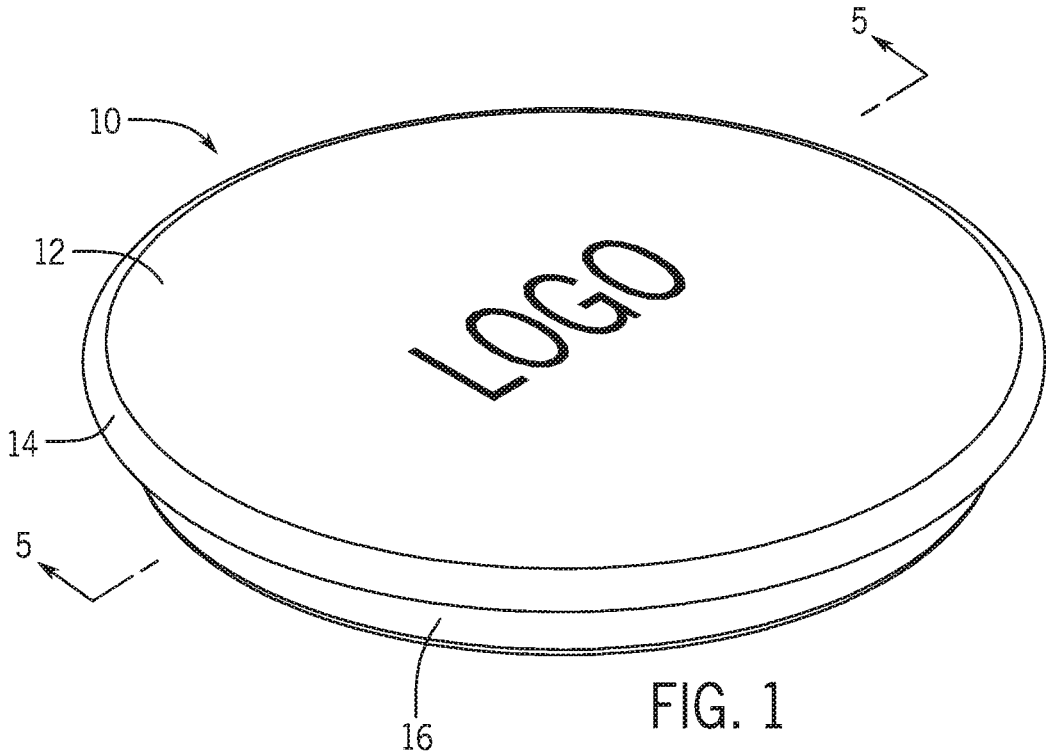
FIG. 1 is a top perspective view of an embodiment of the present invention.
Figure 2:
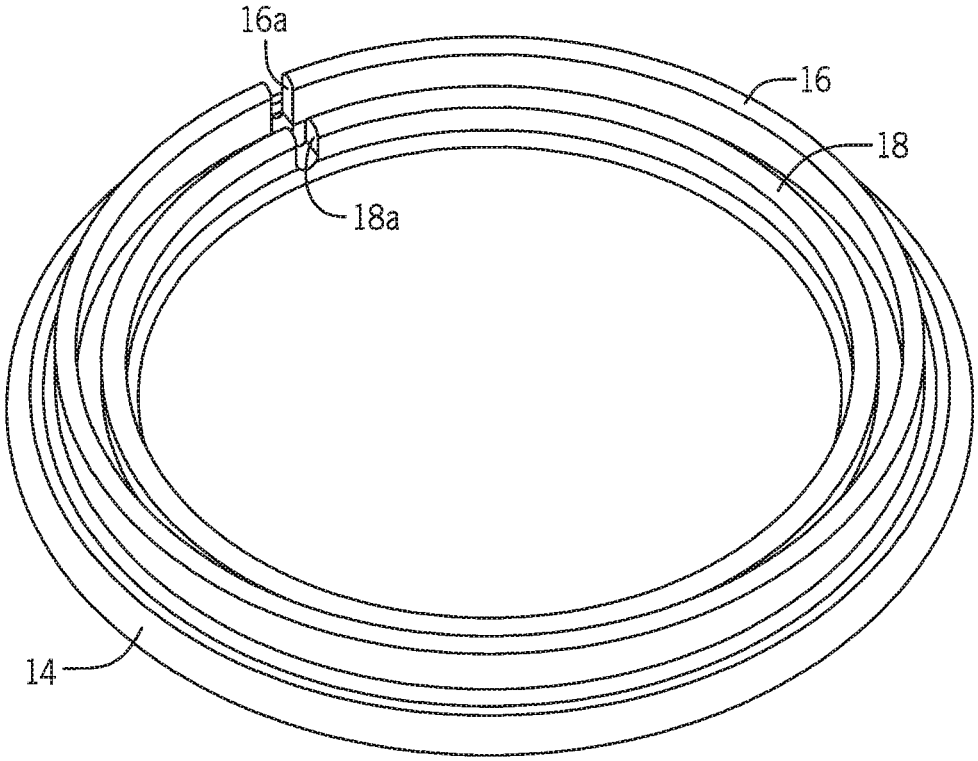
FIG. 2 is a bottom perspective view of an embodiment of the present invention.
Figure 4:
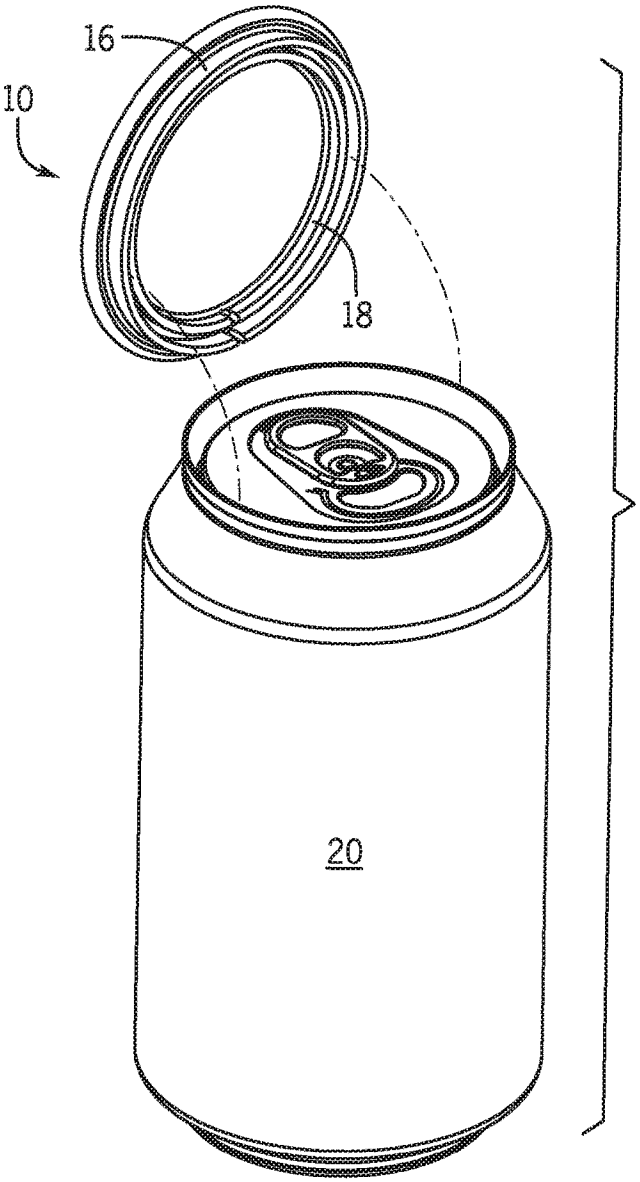
FIG. 4 is an exploded view of an embodiment of the present invention in use.
Figure 3:
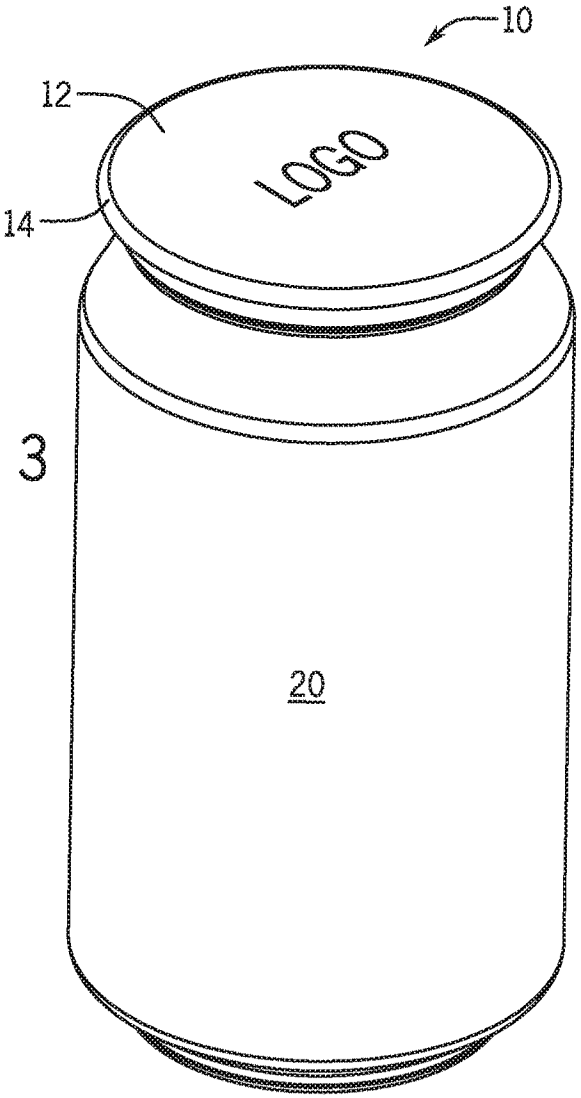
FIG. 3 is a perspective view of an embodiment of the present invention in use.
Figure 5:
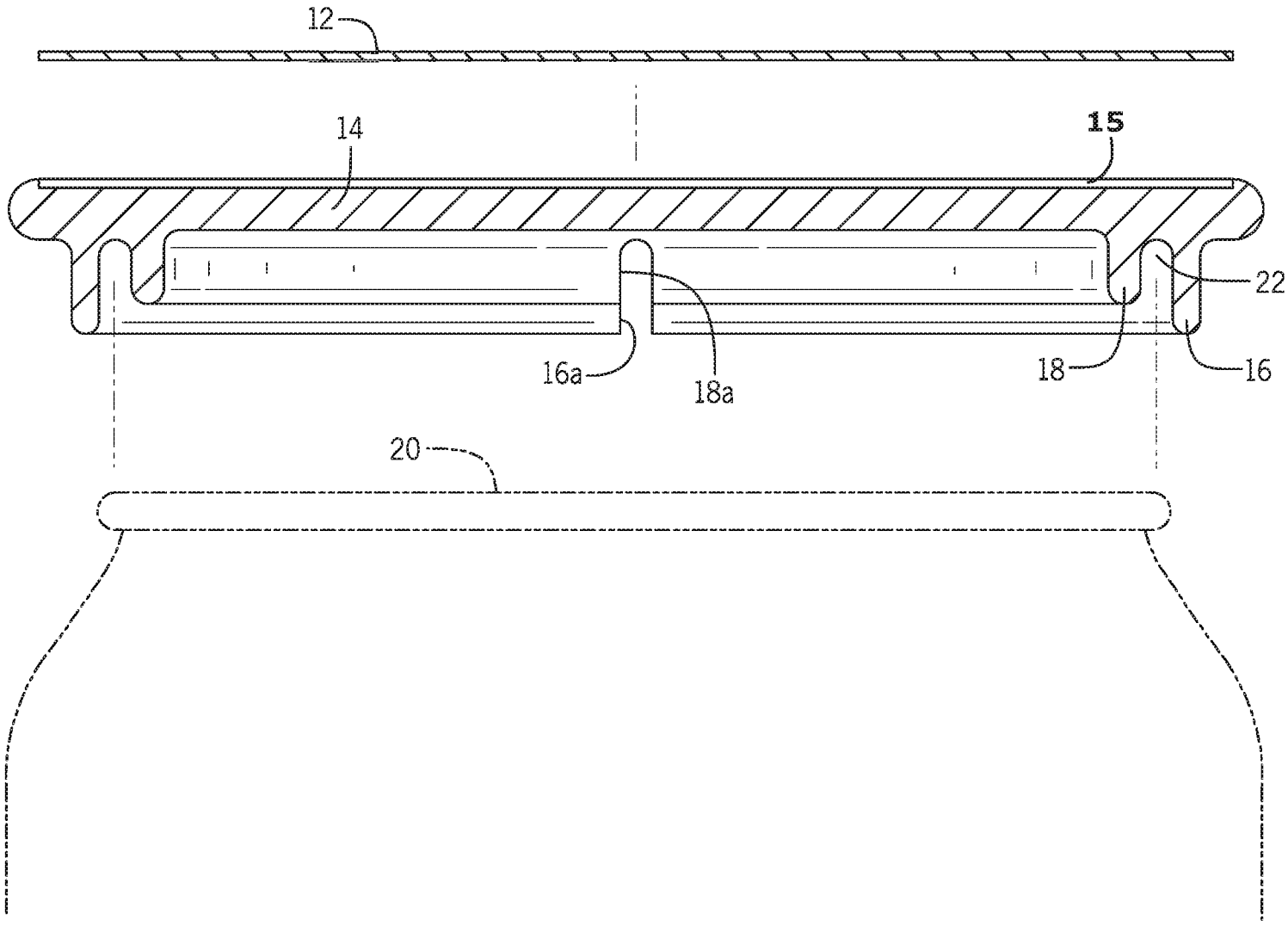
FIG. 5 is a cross-sectional view taken along line 5-5 in FIG. 1.

Referring to FIGS. 1 through 5, the present invention includes a sealing lid 10. The sealing lid 10 includes a lid top portion 14 having an upper surface and a lower surface. An outer concentric ring 16 protrudes from the lower surface of the lid top portion 14. An inner concentric ring 18 protrudes from the lower surface of the lid top portion 14. A channel 22 is defined between the outer concentric ring 16 and the inner concentric ring 18. The sealing lid 10 is configured to releasably secure to a top rim of a beverage can 20 by the top rim friction fitting within the channel 22.

Each of the outer concentric ring 16 and the inner concentric ring 18 include a sidewall having a ring shape. Each of the sidewalls may include a height, which is a distance from a proximal end of the sidewall where the sidewall is adjoined to the lid top portion, and a distal end of the sidewall. The height of the sidewall of the outer concentric ring 16 may be greater than the height of the inner concentric ring 16. Additionally, a slot 16*a* may be formed through the sidewall of the outer concentric ring 16 and a slot 18*a* may be formed through the sidewall of the inner concentric ring 18. The slot 16*a* of the outer concentric ring 16 aligns with the slot 18*a* of the inner concentric ring 18. The slots 16*a*, 18*a* allow a small amount of the carbonation to escape from the beverage can 20 when the lid 10 is attached to relieve pressure. Allowing small amounts of carbonation to escape prevents the lid 10 from popping off the can 20.

The channel 22 of the sealing lid may include a width less than a width of the top edge of the beverage can 20. Further, the sealing lid 10 is made of a solid but bendable or pliable material. For example, the present invention may be made of a polymer, such as Thermoplastic Polyurethane Elastomer (TPU), Polypropylene and the like. When the sealing lid 10 is pressed over the top edge of the beverage can 20, the material bends and the top edge of the beverage can 20 friction fits within the channel 22. The lid 10 is designed to fit over a 2.1 inch can 16.

The lid to portion 14 may be a disc shape having a planar upper surface. In certain embodiments, the upper surface of the lid top portion 14 includes a recess 15. In such embodiments, the present invention may include a plate 12 that releasably fits within the recess 15. The plate 15 may include a logo, a marking, a design, and the like to either identify the drinker of the beverage can 20 or to provide advertising. The recess 15 may define a disk shape and the plate 12 may be a disk shape.

To use the present invention, the sealing lid 10 is pressed against a top of the beverage can 20. The top rim of the beverage can 20 friction fits within the channel 22, in between the outer concentric ring 16 and the inner concentric ring 18. The sealing lid 10 snaps on and secures to the top rim of the beverage can 16, preventing the beverage can 16 from spilling and preventing debris and bugs from entering into the beverage.

It should be understood, of course, that the foregoing relates to exemplary embodiments of the invention and that modifications may be made without departing from the spirit and scope of the invention as set forth in the following claims.

What is claimed is:

1. A sealing lid comprising:

a lid top portion comprising a disk shape having an upper surface and a planar lower surface;

an outer concentric ring protruding from the planar lower surface of the lid top portion; and an inner concentric ring protruding from the planar lower surface of the lid top portion, wherein a channel is defined between the outer concentric ring and the inner concentric ring, and the sealing lid is configured to releasably secure to a top rim of a beverage can by the top rim friction fitting within the channel, wherein the outer concentric ring comprises a slot formed therethrough having an open end at a rim of the outer concentric ring and a closed end at the planar lower surface and the inner concentric ring comprises a slot formed therethrough having an open end at a rim of the inner concentric ring and a closed end at the planar lower surface, wherein the slot of the outer concentric ring aligns with the slot of the inner concentric ring.

2. The sealing lid of claim 1, wherein a height of the outer concentric ring is greater than a height of the inner concentric ring.

3. The sealing lid of claim 1, wherein the upper surface of the lid top portion comprises a recess.

4. The sealing lid of claim 3, further comprising a plate releasably secured within the recess.

5. The sealing lid of claim 1, wherein the sealing lid is a single piece integral unit.

6. A sealing lid comprising:

a lid top portion comprising a disk shape having an upper surface and a planar lower surface;

an outer concentric ring protruding from the planar lower surface of the lid top portion; and an inner concentric ring protruding from the planar lower surface of the lid top portion, wherein a channel is defined between the outer concentric ring and the inner concentric ring, a height of the outer concentric ring is greater than a height of the inner concentric ring, and the sealing lid is a single piece integral unit, wherein the outer concentric ring comprises a slot formed therethrough having an open end at a rim of the outer concentric ring and a closed end at the planar lower surface and the inner concentric ring comprises a slot formed therethrough having an open end at a rim of the inner concentric ring and a closed end at the planar lower surface, wherein the slot of the outer concentric ring aligns with the slot of the inner concentric ring.

7. The sealing lid of claim 6, wherein the sealing lid is configured to releasably secure to a top rim of a beverage can by the top rim friction fitting within the channel.

8. The sealing lid of claim 6, wherein the upper surface of the lid top portion comprises a recess.

9. The sealing lid of claim 8, further comprising a plate releasably secured within the recess.

* * * * *